US006003834A

United States Patent [19]

Read

[11] Patent Number: 6,003,834

[45] Date of Patent: Dec. 21, 1999

[54] FLUID CIRCULATION APPARATUS

[75] Inventor: Dennis M. Read, Houston, Tex.

[73] Assignee: Camco International, Inc., Houston, Tex.

[21] Appl. No.: 08/683,755

[22] Filed: Jul. 17, 1996

[51] Int. Cl.[6] ..... E21B 4/04

[52] U.S. Cl. ..... 251/30.01; 166/66.4; 166/319

[58] Field of Search ..... 251/30.01; 137/155; 166/319, 316, 66.4; 175/61, 62

[56] References Cited

U.S. PATENT DOCUMENTS

| | | | |
|---|---|---|---|
| 2,833,517 | 5/1958 | Bobo . | |
| 3,937,280 | 2/1976 | Dinning | 166/242 X |
| 3,941,190 | 3/1976 | Conover . | |
| 4,373,582 | 2/1983 | Bednar et al. . | |
| 4,768,598 | 9/1988 | Reinhardt . | |
| 5,236,047 | 8/1993 | Pringle et al. . | |
| 5,291,947 | 3/1994 | Stracke . | |
| 5,314,032 | 5/1994 | Pringle et al. . | |
| 5,316,094 | 5/1994 | Pringle . | |
| 5,323,853 | 6/1994 | Leismer . | |
| 5,348,090 | 9/1994 | Leismer . | |
| 5,373,898 | 12/1994 | Pringle . | |
| 5,394,951 | 3/1995 | Pringle et al. . | |
| 5,465,787 | 11/1995 | Roth . | |

FOREIGN PATENT DOCUMENTS

| | | |
|---|---|---|
| 2291904 | 2/1996 | United Kingdom . |
| 2310228 | 8/1997 | United Kingdom . |

*Primary Examiner*—Kevin Lee
*Attorney, Agent, or Firm*—Scott H. Brown

[57] ABSTRACT

A fluid circulation apparatus for interconnection with a wellbore tubing string for particular use in drilling deviated wellbores, such as with coiled tubing. The circulation apparatus has a tubular body member with a longitudinal bore extending eccentrically therethrough and threads for interconnection with a tubing string. A fluid communication port extends through a sidewall of the tubular body member, and a shiftable sleeve is placed thereacross for selectively permitting and preventing fluid flow through the fluid communication port. The valve is biased in a normally closed position by way of a spring and/or hydraulic fluid. Fluid control means, such as a hydraulic fluid source conveyed from a downhole Hydraulic Power Unit to an internal piston, opens or closes the valve in response to electrical signals sent to the Hydraulic Power Unit from the earth's surface.

10 Claims, 14 Drawing Sheets

FLUID CIRCULATION APPARATUS

BACKGROUND OF THE INVENTION

1. Field of the Invention

The present invention relates to a fluid circulation apparatus used for passing fluid from an interior of a drill string to the wellbore's annulus upon command from the surface and, more particularly, to a fluid circulation apparatus that can be used in directional drilling.

2. Description of Related Art

With the world's known oil reserves declining, extraordinary efforts are being made to continue oil production from existing oil fields. One such method is to drill a wellbore at an incline or even horizontally to reach an oil trapped in relatively small pockets. Also, a wellbore can be drilled laterally from an existing wellbore to intersect one or more subterranean faults which can permit additional trapped oil to flow to the wellbore for recovery. The art of being able to steer or guide a drill string at an incline or horizontally to a desired location is usually referred to as "directional drilling". To understand the location of the advancing drill bit from the earth's surface, a directional driller uses various techniques. In some cases, acoustical pulses in the drilling mud are measured and in others sensitive electronic downhole telemetry (telemetric) devices are utilized.

A circulation valve is used to redirect the flow path of drilling fluid, to enable the drill to clear debris, drill cuttings, sloughed formation particles or other such unconsolidated particles which may be restricting movement if either the drill string, or drilling mud from the bit. Since directional drilling is dependent upon downhole motors operated by flowing mud, the circulation valve is necessary to maintain circulation in the drilled interval while the drilling motor is stopped. For this reason it is necessary to be able to close the circulation valve, and reopen it intermittently while drilling. A circulation sub provides a controllable opening so that drilling fluid can be passed from the inside of the drill string to the wellbore's annulus. Typically, circulation subs are mechanically actuated by the dropping of a metal bar or plug within the drill string that causes a localized fluid pressure increase that opens the circulation ports. This type of prior circulation sub is shown in U.S. Pat, No. 3,941,190. This prior circulation sub has the disadvantage of requiring the operator to retrieve or "fish" out the bar or ball before drilling can continue. This prior circulation sub will not close, so it is non-resettable. Additionally, in horizontal wellbores, the ball or bar most likely will not pass downhole to the circulation sub due to the lack of gravity assistance in the horizontal sections of the wellbore.

Other circulation subs that do not require the use of a dropped ball or bar utilize internal pressure relief valves, as shown in U.S. Pat. Nos. 2,833,517 and 4,768,598, acoustic signals, as shown in U.S. Pat. No. 4,373,582, and a dedicated hydraulic control line, as shown in U.S. Pat. No. 5,236,047 (which is commonly assigned hereto). The circulation sub shown in U.S. Pat. No. 5,236,047 utilizes the application of hydraulic fluid through a dedicated control line to open the circulation ports in the circulation sub to permit the fluid to escape to the annulus.

Directional drilling systems will often utilize extremely sensitive downhole electronic measuring devices (often called Measurement-While-Drilling equipment or "MWD") to enable the operator at the earth's surface to determine the location of the advancing drill string and its direction of advancement. Due to the extreme sensitivity of the MWD equipment, other downhole equipment must be designed to not interfere with the MWD equipment. While the circulation sub shown in U.S. Pat. 5,236,047 can be used in highly deviated wellbores and adjacent the extremely sensitive MWD equipment, it does require the use of a dedicated source of hydraulic fluid to operate, which may not be feasible if other hydraulically operated downhole tools are to be operated from the same hydraulic fluid source.

A circulation sub that can be used in highly deviated wellbores and utilized adjacent MWD equipment is shown in U.S. Pat. No. 5,465,787 (which is commonly assigned hereto) and can be actuated from the earth's surface by a signal separate from the hydraulic fluid, which is used to open or close the circulation ports. In this application an umbilical from a surface control panel is required that contains both electric and hydraulic lines to communicate with the circulation sub. The valve is opened by activation of a piloted solenoid which directs hydraulic fluid under pressure to an annular piston. A spring returns the valve to the closed position.

There is a need for an improved circulation valve which is easy to redress, has improved connectivity into a bottom hole assembly, and is opened and closed by hydraulic pressure acting on an annular piston.

SUMMARY OF THE INVENTION

The present invention has been contemplated to overcome the foregoing deficiencies and meet the above described needs. Specifically, the present invention is a fluid circulation apparatus for interconnection with a tubing string, such as a drill sting, that is placed within a wellbore. More specifically, the apparatus includes a tubular body member having a longitudinal bore eccentrically extending therethrough, and having a well known means for interconnection with the tubing string. At least one fluid communication port extends through a sidewall of the tubular body member, and a ported sleeve is sealably placed thereacross for selectively permitting and preventing fluid flow through the fluid communication port. The sleeve is biased, such as by a spring, in a normally closed position to prevent accidental release of drilling fluids in the event that the valve operating mechanism fails, but is normally cycled from open to closed by the application of hydraulic fluid on either end of an operating piston. A fluid control device such as a solenoid valve directs hydraulic fluid in response to electrical signals sent from the earth's surface to the appropriate surface of the operating piston and/or to an exhaust port.

Whereas some prior fluid circulation subs could not be effectively utilized in deviated and horizontal wellbores, the present invention can be easily operated therein due to the fluidic operation of the valve. Whereas some prior fluid circulation subs could not be effectively utilized adjacent sensitive MWD equipment, the present invention can be successfully used because of the use of the relatively low power electrical control signal used to operate the hydraulic controls, which in turn open the fluid circulation ports. Whereas some prior fluid circulation subs can be difficult to assemble, redress and or repair, the present invention has the advantage of easy access to sensitive areas due to the eccentric flow path, and incorporates a novel ribbed seal to minimize damage due to repeated open and close cycles. Whereas some prior fluid circulation subs can fail in the open position due to the sole reliance on a coil spring to a close the fluid communication port, the present invention uses a spring and hydraulic pressure to affect closure. Further, the present invention is able to use hydraulic fluid from an non-dedicated source, or in the preferred embodiment a downhole Hydraulic Power Unit, so the fluid circulation ports can be operated independently from other hydraulically operated downhole tools without the need for multiple dedicated fluid control lines.

DETAILED DESCRIPTION OF THE PREFERRED EMBODIMENTS

As has been described generally above, the present invention is a fluid circulation apparatus for interconnection with a wellbore's tubing string for particular use in drilling deviated wellbores. The fluid circulation apparatus has a tubular body member with a longitudinal bore extending eccentrically therethrough and threads on each end for interconnection with a tubing string. At least one fluid communication port extends through a sidewall of the tubular body member, and a sleeve is sealably placed across the at least one fluid circulation port for selectively permitting and preventing fluid flow from an interior of the longitudinal bore to the wellbore's annulus. The valve is biased in a normally closed position by way of a spring so that in the event that the valve's operating devices fail, drilling fluid will be prevented from escaping to the annulus. Fluid control means, such as hydraulic fluid, operates the valve from a non-dedicated source, preferably a downhole Hydraulic Power Unit, such as disclosed in U.S. Pat. No. 5,314,032 that operates in response to electrical signals sent from the earth's surface.

It should be understood that the fluid circulation apparatus of the present invention can be used in any downhole operation that needs a mechanism for venting or circulating fluid from inside a tubular member to outside the tubular member in a controlled manner. Specifically, the fluid circulation apparatus is used with conventional rotary drilling (where the drill string is rotated from the surface) and with downhole motors and turbines. The fluid circulation apparatus is used to drill a relatively straight wellbore, an inclined wellbore, a deviated wellbore that has several changes in direction, and a horizontal wellbore. Additionally, the fluid circulation apparatus of the present invention is used with a conventional drill string, formed from interconnected lengths of pipe, and with coiled tubing, which is a continuous length of tubing which is spooled into the wellbore, both of which are well known in the art.

Figure 1:
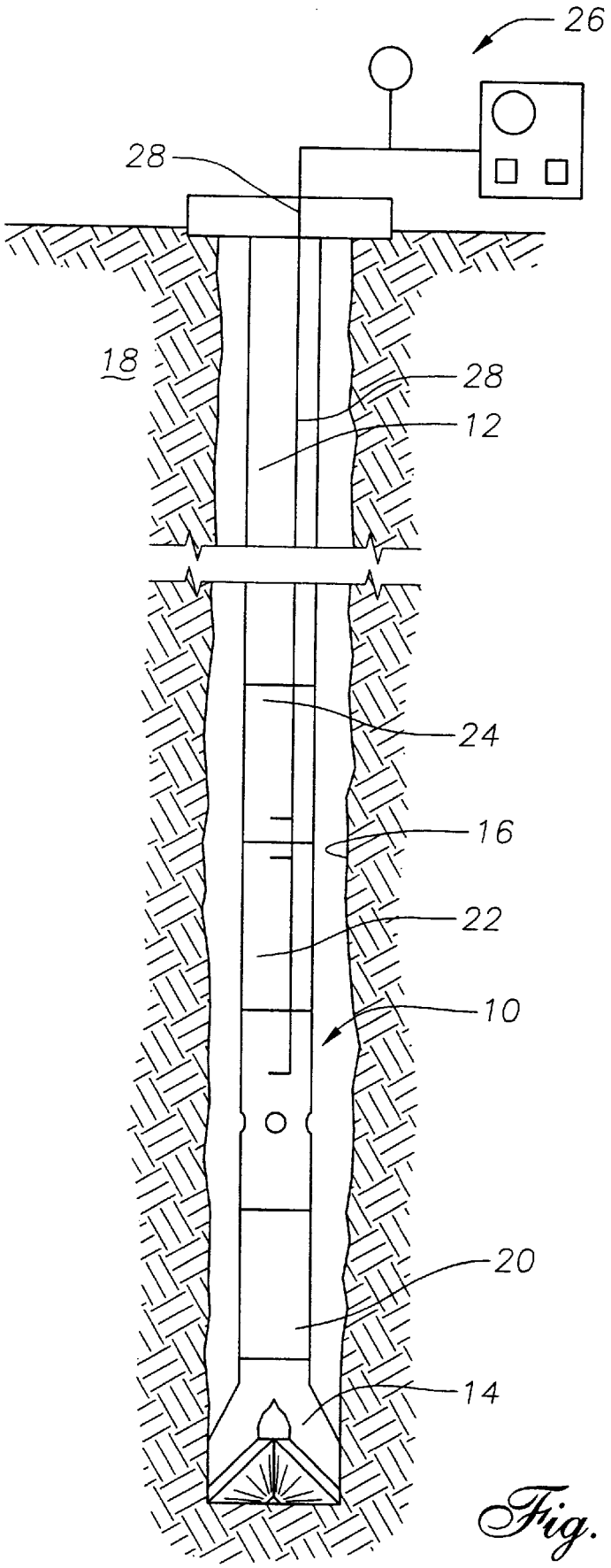
FIG. 1 is a semidiagrammatic side elevational view of one preferred embodiment of a fluid circulation apparatus embodying the present invention showed connected to a tubing string used to drill a subterranean wellbore.
Figure 2A:
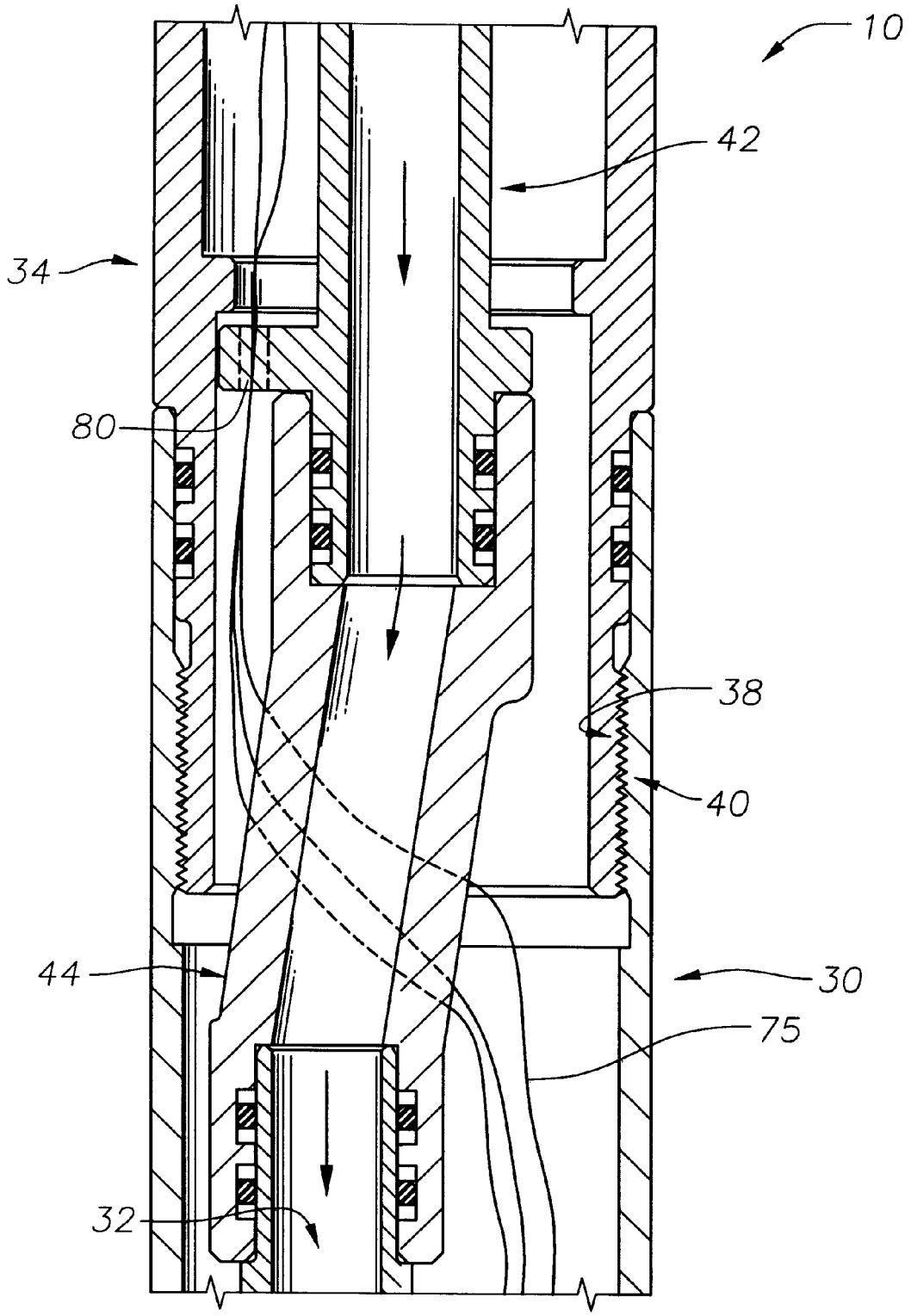
FIG. 2 is a cross-sectional side view of a preferred embodiment of a fluid circulation apparatus embodying the present invention to show fluid circulation ports in a closed position.
Figure 2B:
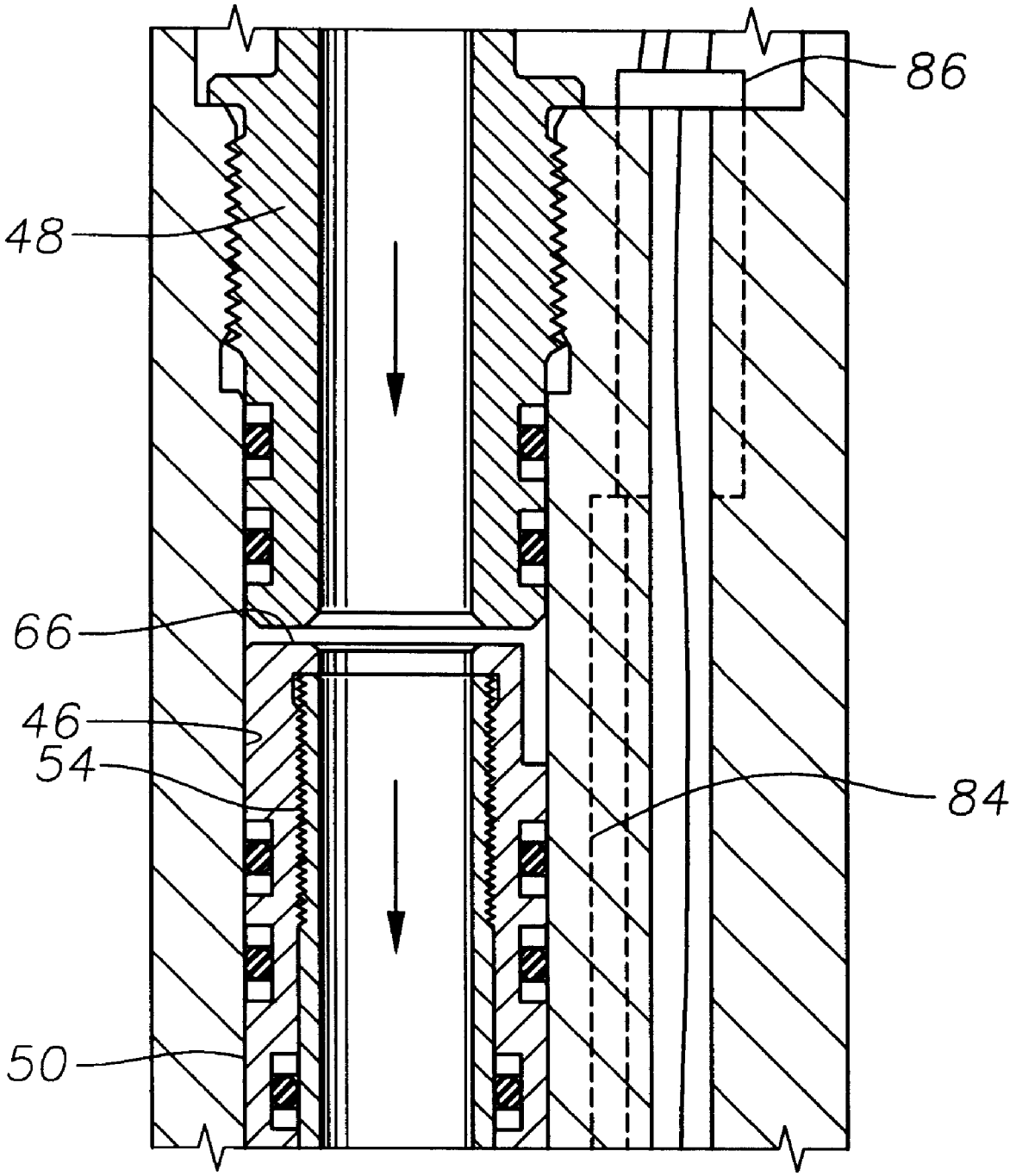
Figure 2C:
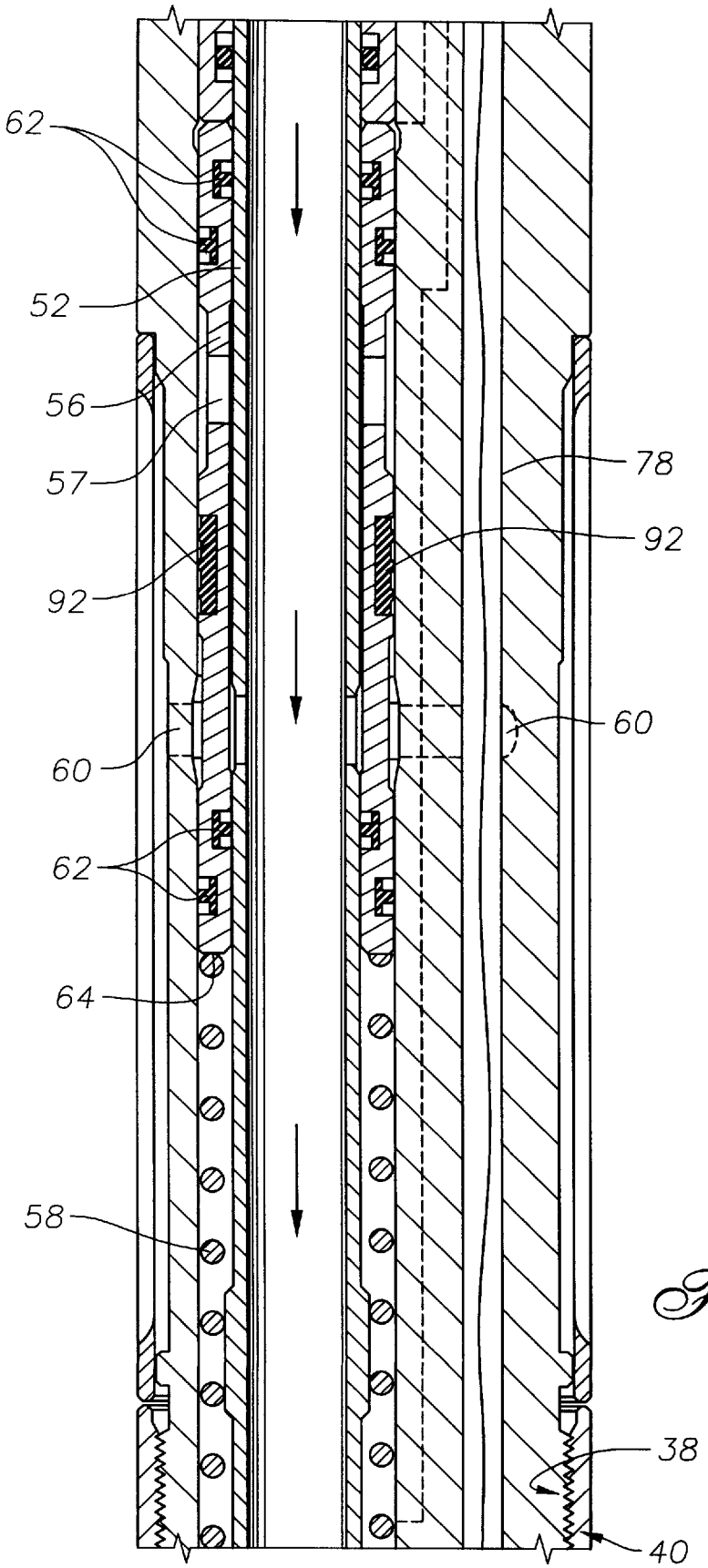
Figure 2D:
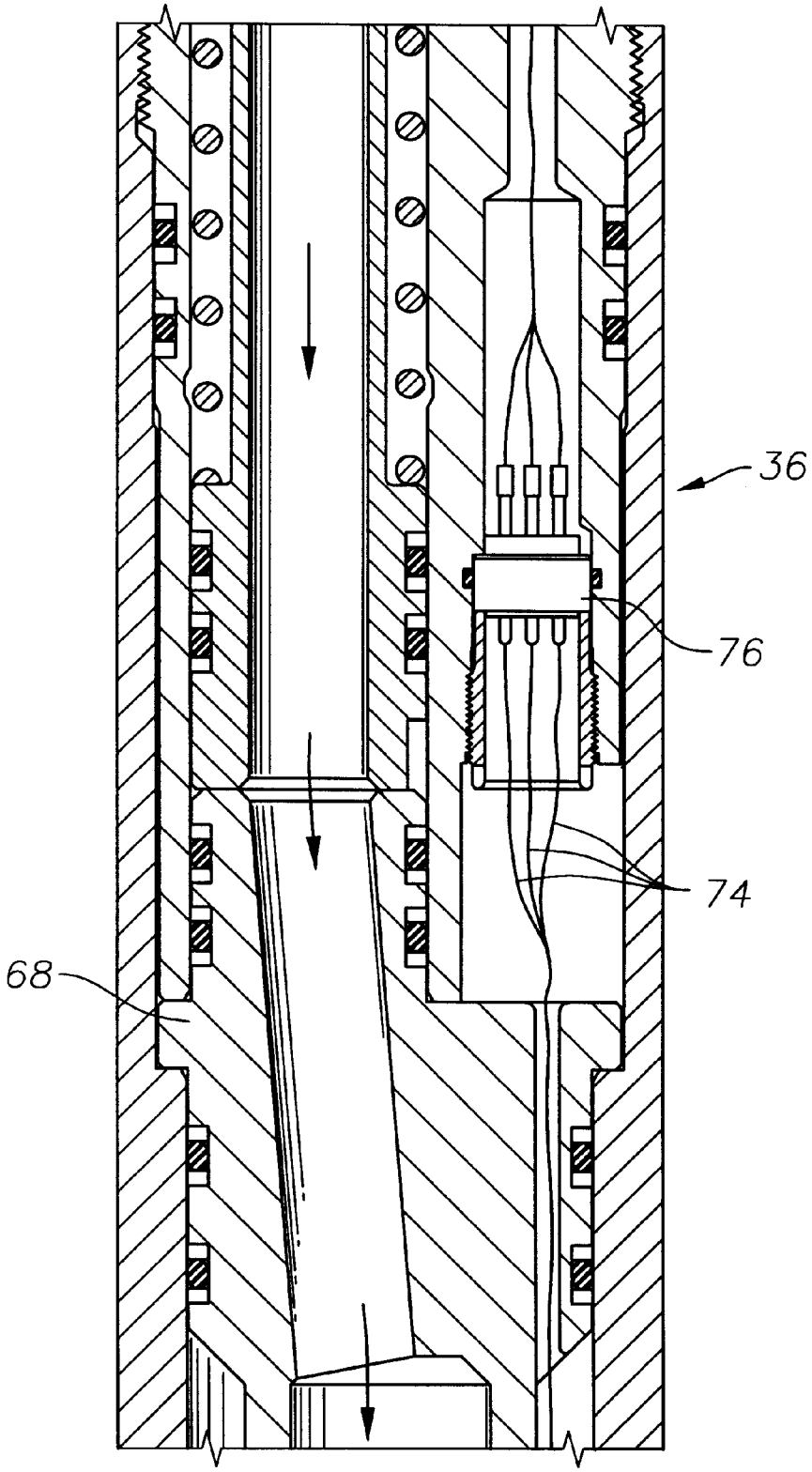
Figure 2E:
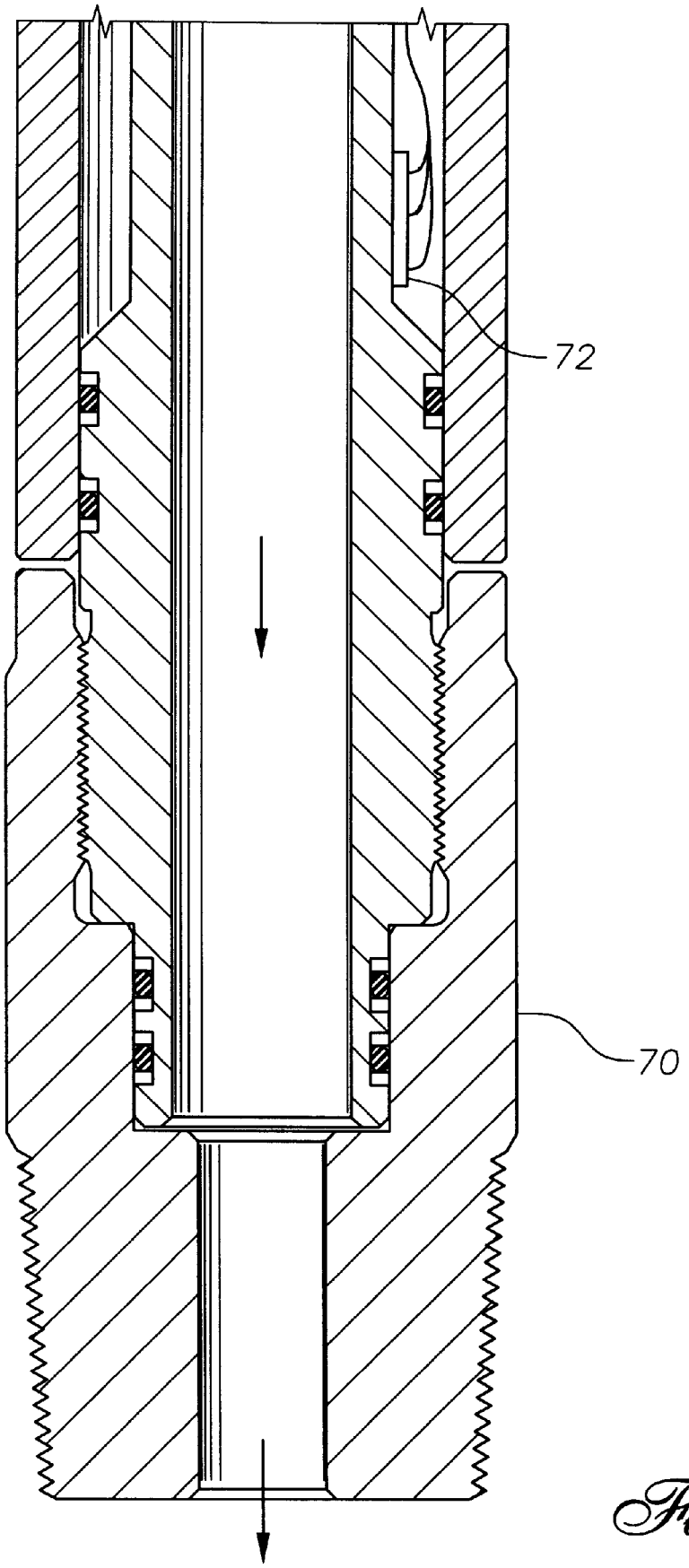
Figure 3A:
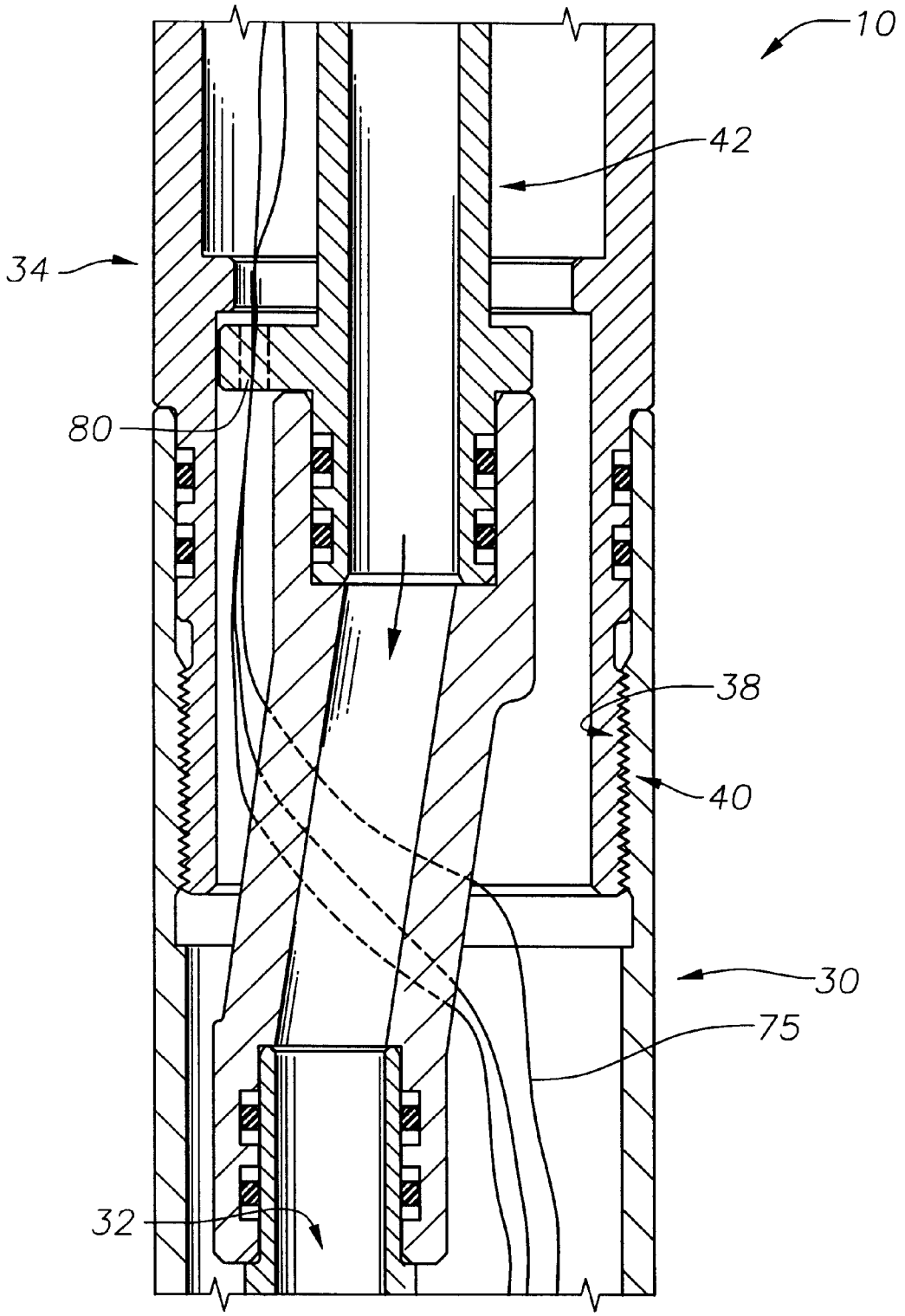
FIG. 3 is a cross-sectional side view of a preferred embodiment of the fluid circulation apparatus embodying the present invention to show the fluid circulation ports in an open position.
Figure 3B:
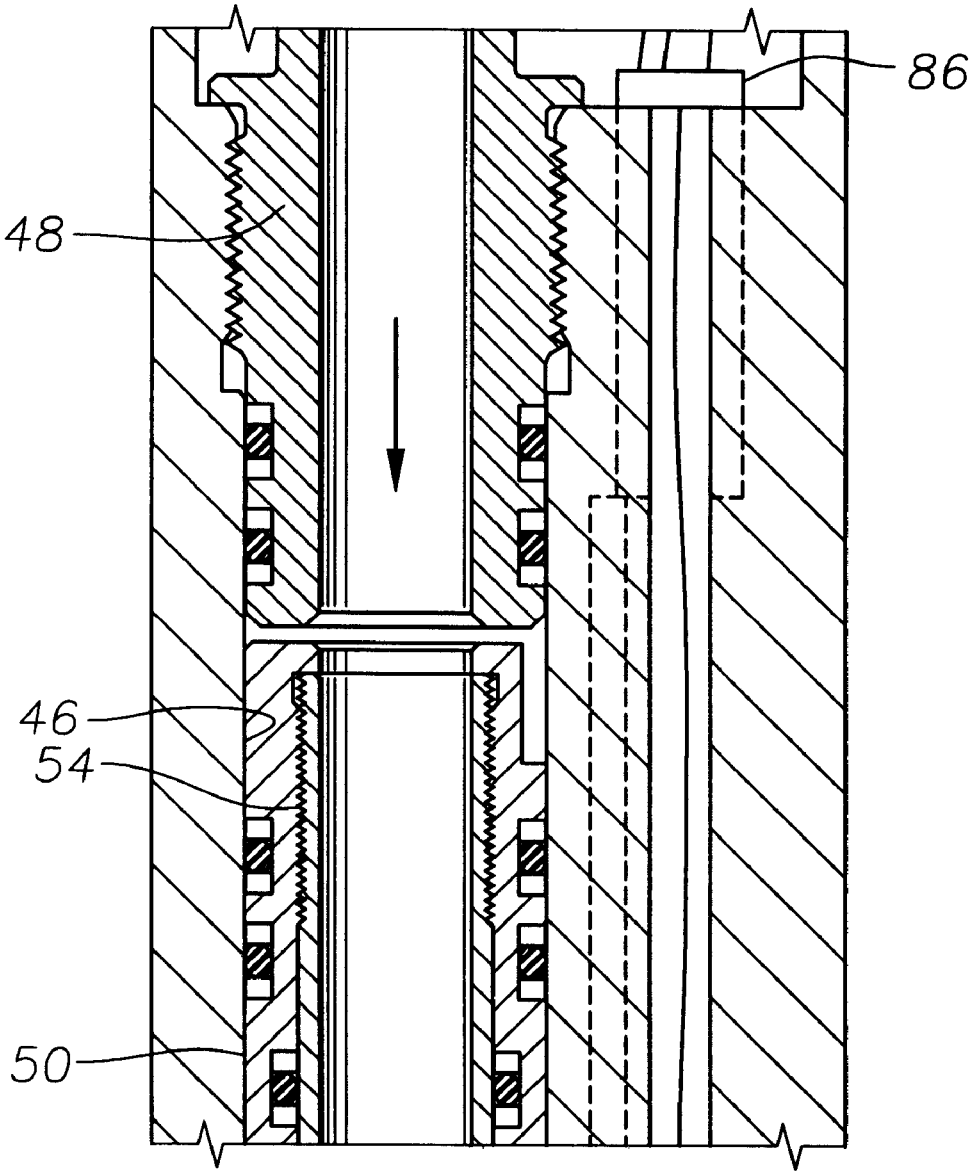
Figure 3C:
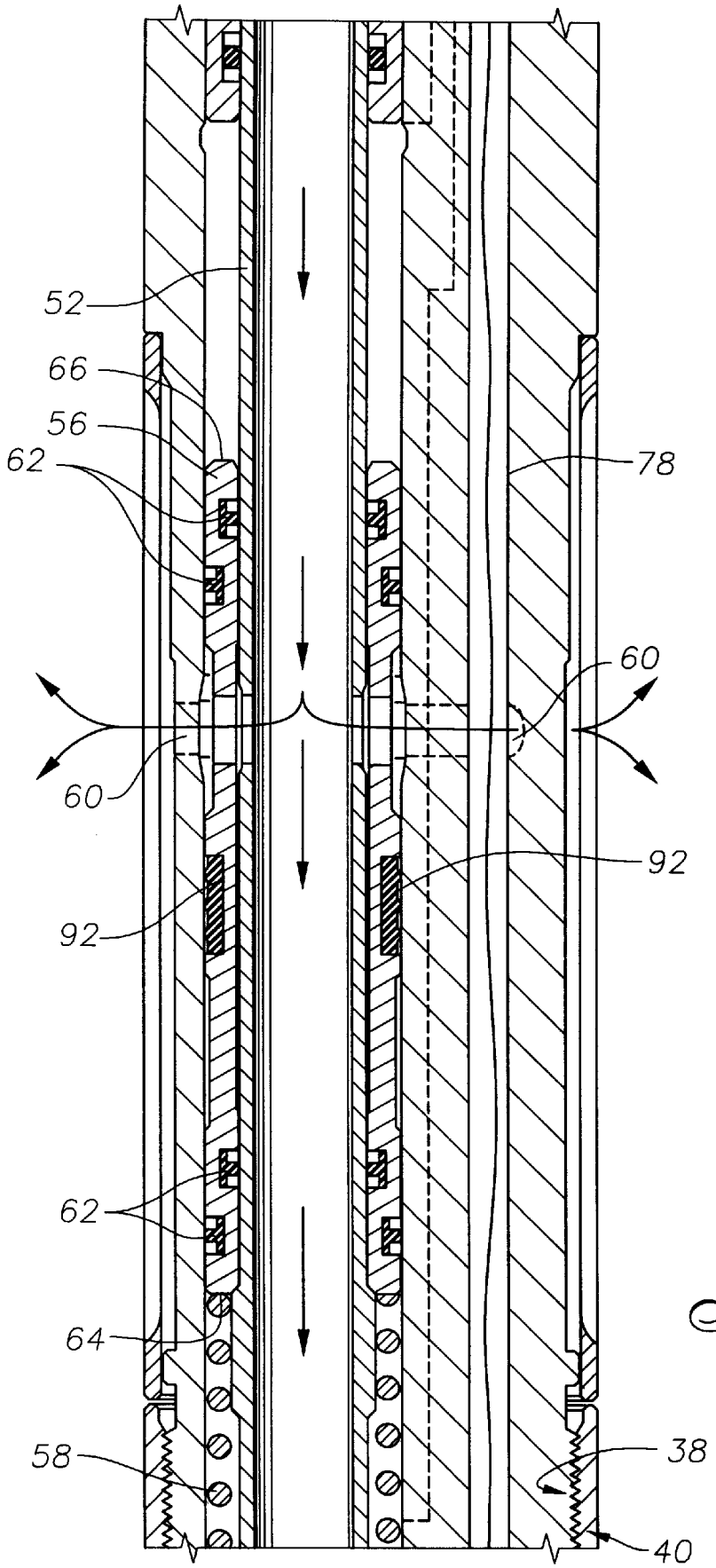
Figure 3D:
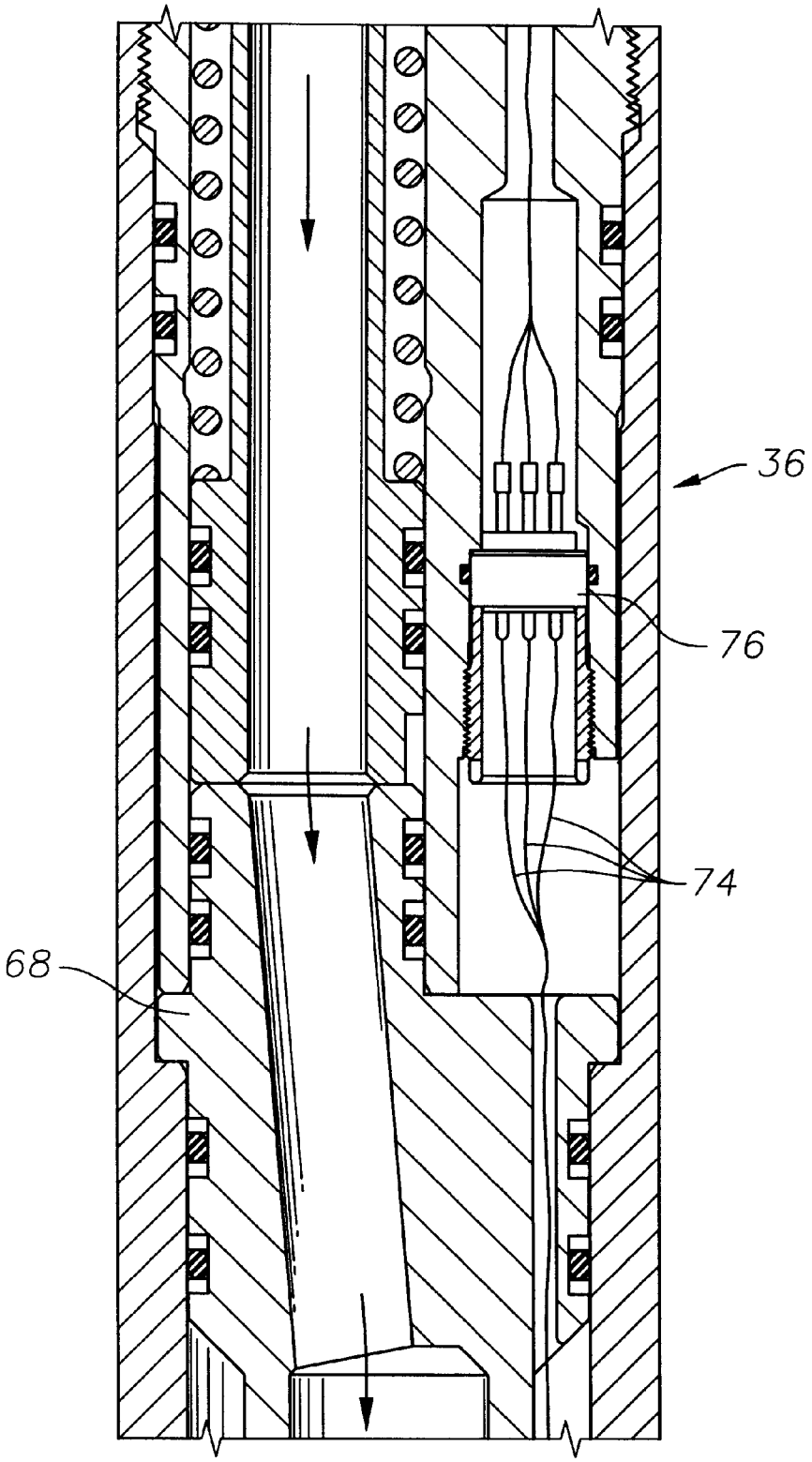
Figure 3E:
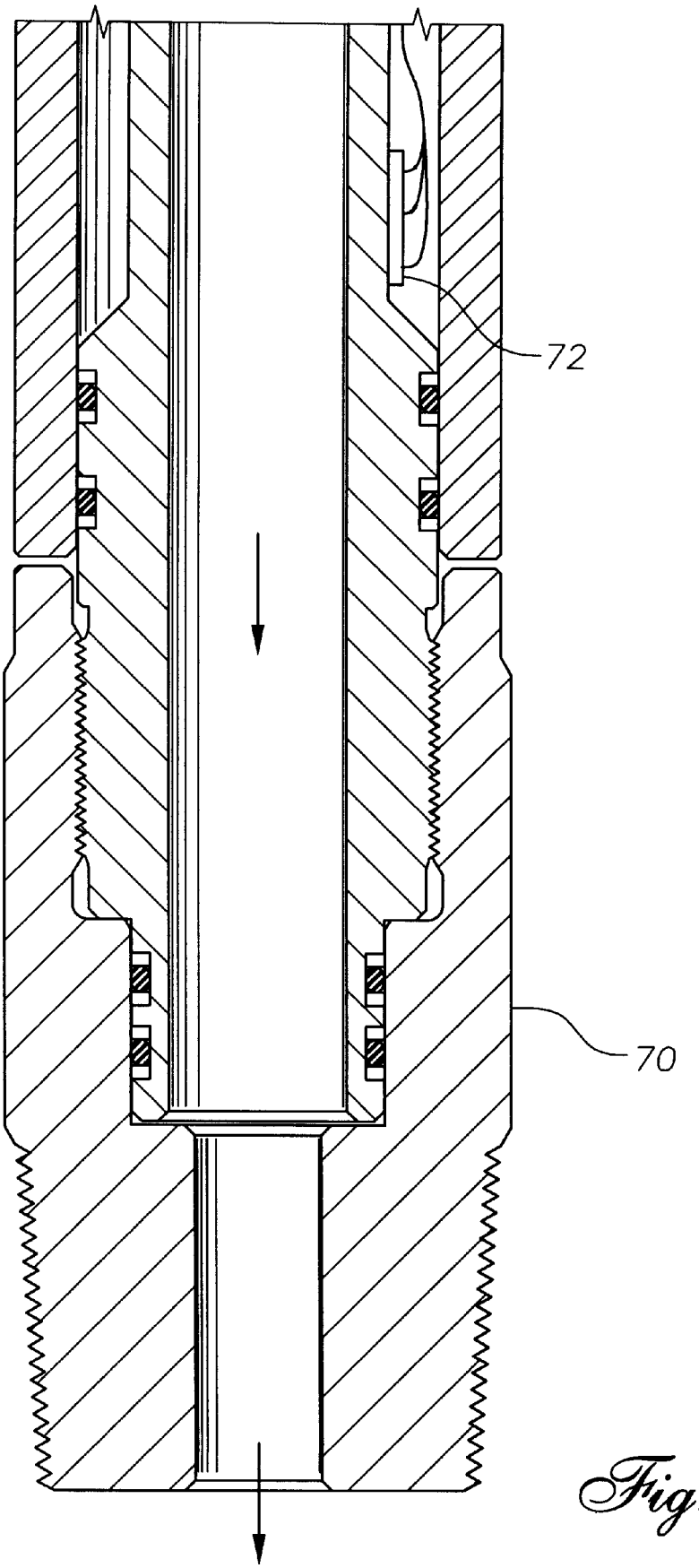

As shown in FIG. 1, one preferred embodiment of a fluid circulation apparatus 10 of the present invention may be connected to a drill string 12. The drill string 12 can be a conventional threaded, multiple joint drill string, but for the purposes of the present discussion it will be assumed that the drill sting is a continuous coiled tubing. Connected to a lower end of the drill string 12 is a drill bit 14, which when rotated will create a wellbore 16 in a subterranean earthen formation 18. The drill bit 14 is rotated by operation of a downhole motor or turbine 20 which is operated by the flow of drilling fluid passed through the interior of the drill string 12 from pumps (not shown) at the earth's surface, as is well known to those skilled in the art.

When a deviated or horizontal wellbore 16 is to be drilled, it is common to include electronic equipment that can provide signals to the operator at the earth's surface that indicates the direction and inclination of the wellbore 16. This equipment is usually referred to as Measurement-While-Drilling (MWD) equipment, and same is shown included in the drill string 12 by reference numeral 22. Additionally, in one preferred use of the present invention, the fluid circulation apparatus 10 is used in conjunction with one or more pieces of specialized equipment adapted to permit drilling with coiled tubing. These pieces of equipment are generally indicated by reference numeral 24, and are fully described in commonly assigned U.S. Pat. Nos. 5,465,787, 5,314,032, 5,316,094, 5,323,853, 5,348,090, 5,394,951, 5,323,853 and 5,373,898; all of which are incorporated herein by reference.

As will be described in more detail below, the MWD equipment 22 provides its signals through mud pulses, pulses of acoustic and/or electromagnetic energy, and/or signals through dedicated conduits or wires to a control and display panel 26 at the earth's surface, all as is well known in the art. Further, the control and display panel 26 is used for the operation of the coiled tubing drilling equipment 24 and the fluid circulation apparatus 10, which both require the use of electronic signals sent to the downhole equipment through dedicated electrically conductive wires 28.

As shown in FIGS. 2 and 3, the fluid circulation apparatus 10 of one preferred embodiment of the present invention is comprised of a circulating body member 30. The circulating body member 30 includes an passageway 32 extending eccentrically therethrough for the downward passage of drilling fluid. The upper end of the circulating body 30 is sealably affixed to a tubing connector 34 , and the lower end is similarly affixed to a load cell housing 36. Such connecting means are in the form of a threaded pin 38 and a threaded box opening 40, as are well known in the art, or other suitable connection devices.

A seal sleeve directs the flow of fluid from the drill string 12 to an upper crossover 44 which diverts fluid to the eccentric passageway 32 through a retainer 48, and into the eccentric passageway 32. The placement of parts in this fashion enables rapid disassembly and redress, which permits the tool to be placed back in service more rapidly than previous circulating valves.

A cap 50 is inserted in the eccentric passageway 32 and seals against a longitudinal bore 46 on its outside diameter and a piston rod 52 on its inside diameter. A threaded connection 54 serves to attach the cap 50 to the piston rod 52, and the piston rod 52 extends essentially the full length of the longitudinal bore 46. Disposed around the piston rod 52 is a piston 56 with ports 57 and a spring 58. The cap 50 traps the piston 56, and spring 58 on the piston rod 52, forming a redress "cartridge" subassembly. This configuration enables quick removal and insertion of the parts most likely to suffer damage when the fluid circulation apparatus 10 is repeatedly actuated.

The piston 56 translates longitudinally between a closed position shown in FIG. 2, whereby fluid flows longitudinally through the fluid circulation apparatus 10, and an open position shown in FIG. 3, whereby fluid may be diverted through at least one circulation port 60.

With the spring 58 normally extended (as shown in FIG. 2), the piston 56 is biased into a position so that the ports 60 are not aligned with the ports 57. By action of a set of dynamic seals 62 and the non-alignment of the ports 60 and 57, drilling fluid is prevented from passing from the eccentric passageway 32 to the annulus. In other words, the spring 58 is used to bias the valve or piston 56 into a normally closed position, but closure is assisted by action of hydraulic pressure on the lower end 64 of the piston 56. Conversely, when hydraulic fluid is applied to the upper end 66 of the piston 56 at a pressure greater than the force from the spring 58, the piston 56 is moved to compress the spring 58 and bring the ports 60 and 57 into alignment. As shown in FIG. 3 once the ports 60 and 57 are in alignment, drilling fluid within the eccentric passageway 32 is permitted to pass into the wellbore's annulus for the purposes known to those skilled in the art of the use of a fluid circulation apparatus 10. Repeatedly sealing the ports 60 and 57 after numerous open and close cycles is aided by a novel ribbed seal 92 which is discussed in detail hereinafter.

FIGS. 2 and 3 also show a load cell sub 68 inserted into the eccentric passageway 32, and on the lower end, into a lower connector 70. The load cell sub 68 serves to move the flow from the eccentric passageway 32, back into a concentric flow configuration embodied in the lower connector 70. A strain gauge 72 is attached to the outer wall of the load cell sub 68, and provides continuous readings of metallurgical strain present in the load cell sub 68, through wires 74 as shown. The wires 74 that provide indications from the load cell sub 68 run through a connector 76 as well as through feedthrough channels 78 and 80 and eventually communicate with the display panel 26, and gives a positive indication of the condition of stress of the load cell sub 68, which in turn gives an indication of how much weight is on the bit 14, and/or torque is being applied to the drilling assembly shown in FIG. 1 as a whole. This information helps the driller to accurately determine the best course of action for drilling the wellbore 16 on a dynamic, real-time basis.

Figure 4:
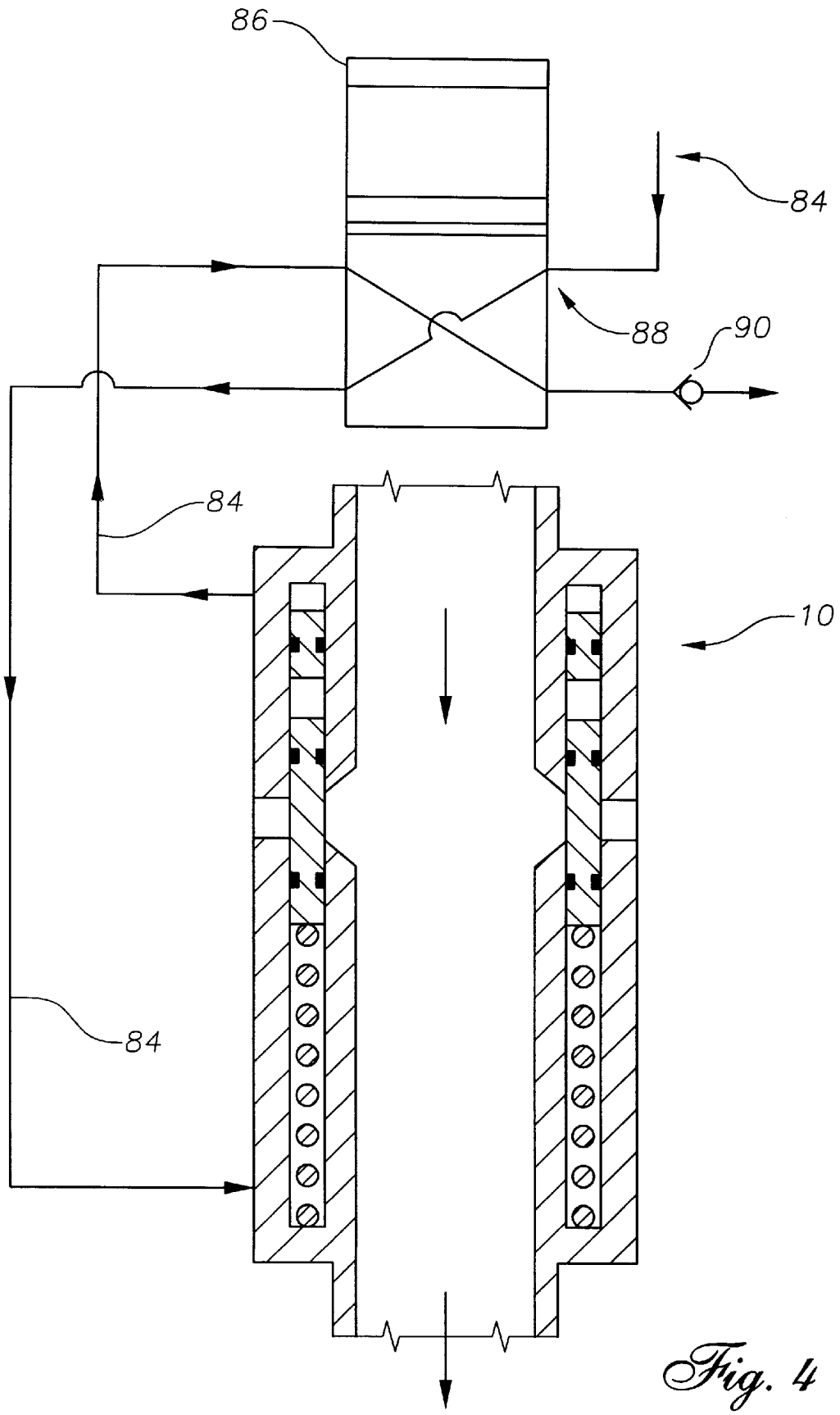
FIG. 4 is a schematic drawing of the solenoid valve used in one preferred embodiment of the present invention where the hydraulic fluid is directed in a manner that would close the fluid circulation ports.
Figure 5:
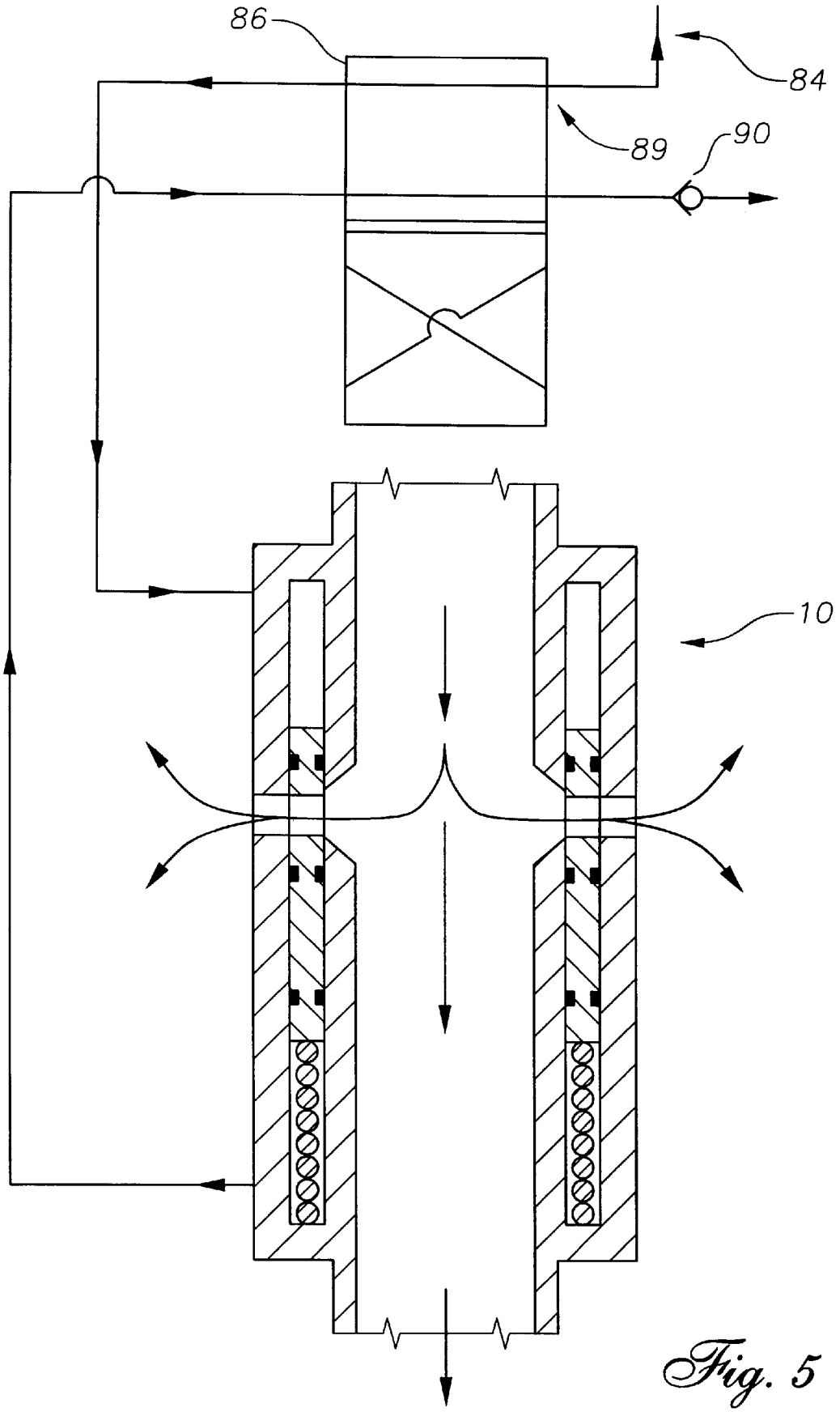
FIG. 5 is a schematic drawing of the solenoid valve used in one preferred embodiment of the present invention where the hydraulic fluid is directed in a manner that would open the fluid circulation ports.

FIGS. 4 and 5 schematically illustrate the routing of hydraulic fluid, which is used to move the piston 56 to open or close the valve. This hydraulic fluid can be supplied through a control line or a hydraulic conduit 84 which is routed from a pressurized hydraulic fluid source (not shown) to an electrically actuated solenoid valve 86.

Referring to FIG. 4, the loss of electrical energy from the surface causes the solenoid valve 86 to move into the configuration shown. Hydraulic fluid moves through the hydraulic conduit 84 and into a first inlet port 88 on the solenoid valve 86. The solenoid valve 86 then directs the fluid into another hydraulic conduit 84, which communicates with the lower end 64 of the piston 56. The force of the hydraulic pressure additive with the force of the spring 58 serves to assure the valve remains closed. Hydraulic fluid acting on an upper end 66 of the piston 56 is vented, allowing the piston 56 to move up and close the circulation ports 60.

Referring to FIG. 5, an electrical signal from the surface excites the solenoid valve 86 and urges movement into the configuration shown. Hydraulic fluid moves through the hydraulic conduit 84 and into a second inlet port 89 on the solenoid valve 86. The solenoid valve 86 then directs the fluid into another hydraulic conduit 84, which communicates with the upper end of the piston 56. The force of the hydraulic pressure overcomes the force of the spring 58 serves to move the valve to the open position. Hydraulic fluid acting on the lower end of the piston 56 is vented, allowing the piston 56 to move downward and open the circulation ports 60.

The present invention can be used with a common hydraulic fluid source but preferably from a downhole power source, such as a Hydraulic Power Unit. Further, the present invention can be used adjacent to extremely sensitive MWD equipment because it utilizes relatively low electrical power to operate the valve device. The solenoid valve device 86 can be any commercially available fluid control valve that opens or closes a fluid passageway by the application of mechanical motion from a separate control source. The separate control source can be a separate hydraulic control line or, preferably, the control source is the application of electrical energy. In one preferred embodiment of the present invention, the solenoid valve 86 is an electrically operated piloting solenoid valve sold by BEI Technology Co. and it requires relatively low power, such as 28 volts DC and 0.3 amperes. If only electrical power was used to move the sleeve, such as by a solenoid coil rather than the continuation of hydraulic and electrical power, the amount of electrical energy needed to move the sleeve would create a magnetic field that would cause errors in the signals received within the MWD equipment.

The solenoid valve 86 is arranged so that the fluid circulation apparatus 10 is closed unless a specific application of electrical energy is received thereby. This set-up of the fluid circulation apparatus 10 is to ensure that it is fail-safe. In other words, if electrical power is lost, the other downhole equipment 24 that requires the use of the hydraulic fluid will not be affected, and drilling could be resumed or continued without the use of the fluid circulation apparatus 10.

In the operation of the present invention described above, the tubing connector 34 is threadably connected to the tubing string 12 together with the other equipment 14, 20, 22 and/or 24. Control wires 82 are operatively connected to the surface controls 26. During the drilling operation, hydraulic fluid is passed from the Hydraulic Power Unit (not shown) through its dedicated conduit and is used to operate various pieces of coiled tubing drilling equipment 24, as described in detail in the above identified commonly assigned U.S. Patents. When the operator determines that circulation of drilling fluid is needed, an electrical signal is sent from the surface controls 26 through the control wires 82 to the solenoid valve 68. As shown in FIGS. 4 and 5, the internal solenoid valve 86 in the fluid circulation apparatus 10 is energized and directs hydraulic fluid to the upper end 66 of the piston 56. The piston 56 compresses the spring 58 so that the ports 60 permit fluid flow from the interior of the longitudinal bore 32 to the wellbore's annulus.

When the operator determines that the flow of drilling fluid to the annulus should cease, the operator adjusts the surface controls 26 so that electrical energy is no longer applied to the valve. Thus, the internal solenoid 86 in the fluid circulation apparatus 10 shifts, and redirects hydraulic fluid to the lower end 64 of the piston 56 which moves upward with the assistance of the spring 58 such that the ports 60 are not in alignment which stops the flow of drilling fluid out therefrom. Hydraulic fluid acting on the upper end 66 of the piston 56 vented to the annulus through a hydraulic conduit 84 which is provided with a one-way check valve 90 to prevent the in-flow of wellbore fluid.

Figure 6:
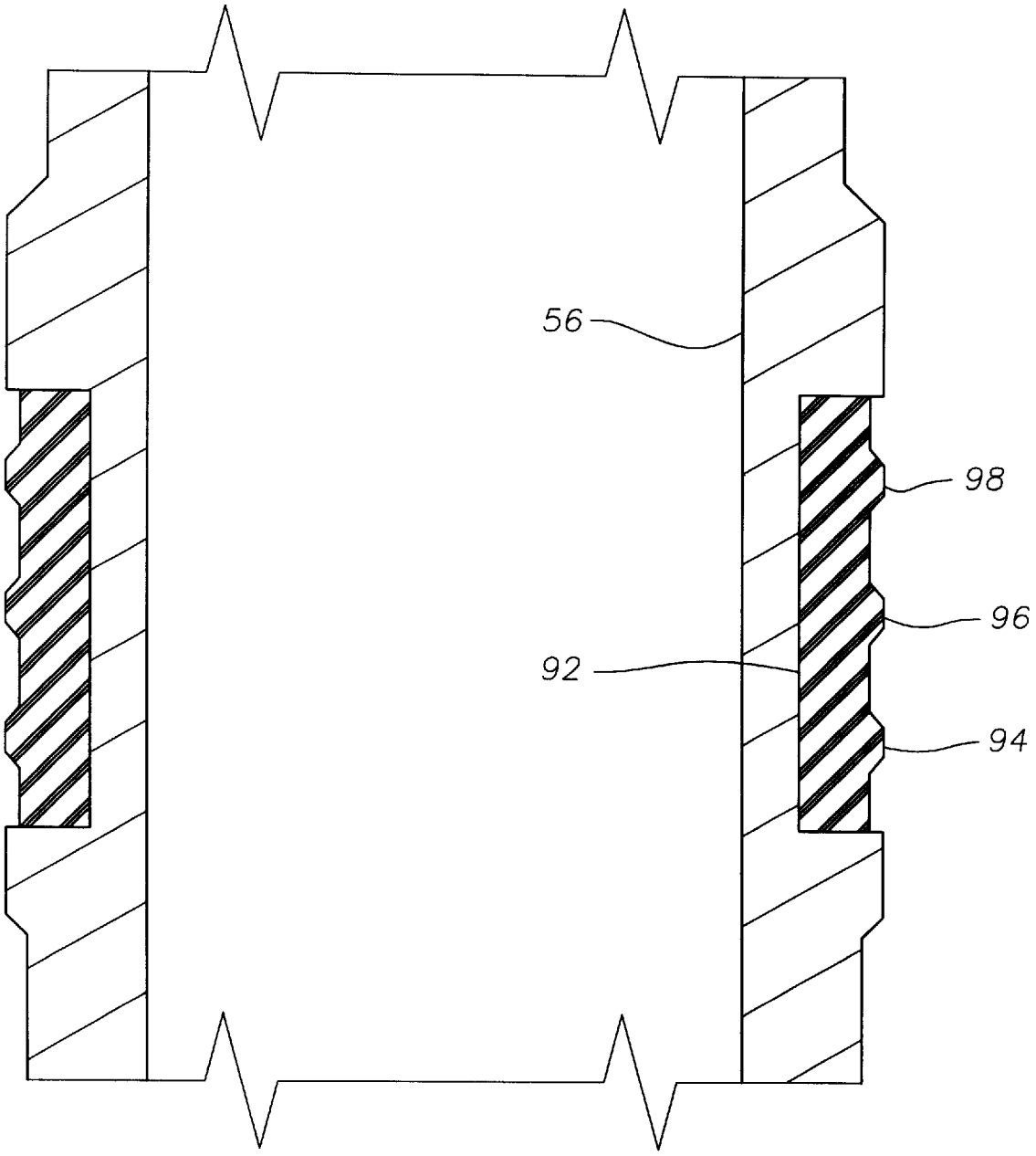
FIG. 6 is a cross sectional side view of a preferred embodiment of a ribbed seal as a component of the present invention, that assures repeated open and close cycles can be performed with a minimum of seal damage.

Referring now to FIG. 6, a ribbed seal 92 is shown preferably affixed to the piston 56 by a process known to those skilled in the art as "vulcanizing". One of the most difficult sealing applications known is equalizing differential pressure over a seal as it being moved over a port. The seal can be damaged by debris around the seal, it can be damaged by extrusion due to the high differential pressure, it can be damaged mechanically as the seal moves over the port, and it can be damaged by fluid flow erosion as equalizing occurs between the volumes of differential pressure. While these seal damaging effects cannot be eliminated in the present invention, the geometry of the ribbed seal minimizes them, and assures a longer service life. The ribbed seal 92 made of a resilient material such as any number of well known elastomers and/or plastics, and/or malleable metals and is configured so as to have a plurality of processes or ribs. For the purpose of illustration, FIG. 6 shows three ribs but more or less may be utilized and still be within the scope and spirit of the present invention. A first rib 94 is the primary seal, and acts as a wiper to remove any debris that may be present as the seal begins to move. A second rib 96 is positioned in the center between the first rib 94 and a third rib 98. While the pressure drop across the entire ribbed seal 92 remains relatively constant in application, the presence of multiple ribs reduces the pressure drop across individual ribs thereby minimizing damage. Even if the first rib 94 becomes damaged, it does continue to serve to protect subsequent ribs. The use of the ribbed seal minimizes seal damage in this difficult application and extends the time the fluid circulation apparatus 10 of the present invention can remain in service.

As has been described above, the present invention permits the use of a fluid circulation apparatus within horizontal wellbores because it does not need use the dropping of a ball or bar for its operation. It is easy to redress and repair, and utilizes hydraulic fluid to open and close the fluid circulation apparatus 10. The present invention is resettable to a closed position, and as such can be operated as desired.

Whereas the present invention has been described in relation to the drawings attached hereto, it should be understood that other and further modifications, apart from those shown or suggested herein, may be made within the scope and spirit of the present invention.

What is claimed is:

1. A fluid circulation apparatus for interconnection with a wellbore tubing string, comprising:

a tubular body member having an eccentric longitudinal bore extending there through, and having means for interconnection with a tubing string;

at least one fluid communication port extending through a sidewall of the tubular body member;

valve means for selectively permitting and preventing fluid flow through the fluid communication port;

means for biasing the valve means in a normally closed position; and fluid control means for operating the valve means in response to electrical signals sent to the control means from the earth's surface, comprising an electrically operated valve mounted within a space within the tubular body member, and adapted to selectively apply hydraulic fluid from a downhole source to open the valve means and to close the valve means in response to electrical signals sent by wires to the control means from the earth's surface.

2. A fluid circulation apparatus of claim 1 wherein the tubing string is coiled tubing.

3. A fluid circulation apparatus of claim 1 wherein the means for interconnection comprise threaded pipe connections.

4. A fluid circulation apparatus of claim 1 wherein the means for interconnection comprise pinned connections.

5. A fluid circulation apparatus of claim 1 wherein the means for interconnection comprise coupled connections.

6. A fluid circulation apparatus of claim 1 wherein the means for interconnection comprise pipe connections held by slips.

7. A fluid circulation apparatus of claim 1 wherein the valve means comprises a tubular piston mounted eccentrically and is adapted to slide longitudinally within an interior annular space within the tubular body member, the sleeve having at least one port therethrough.

8. A fluid circulation apparatus of claim 1 wherein fluid control means comprises an electrically operated solenoid valve mounted within a space within the tubular body member, and adapted to selectively apply hydraulic fluid to operate the valve means.

9. A fluid circulation apparatus of claim 7 wherein the tubular piston utilizes a ribbed seal.

10. A fluid circulation apparatus of claim 7 wherein a conduit conveying hydraulic fluid to the fluid control means is in operative fluidic communication with separately operable equipment connected to the tubing string.

* * * * *